United States Patent [19]

Pike et al.

[11] Patent Number: 4,728,152

[45] Date of Patent: Mar. 1, 1988

[54] BOREHOLE EXTRACTION OF MINERALS

[75] Inventors: William C. Pike, Caterham; Timothy R. Woolmington, Sunbury-on-Thames, both of England

[73] Assignee: British Petroleum Company p.l.c., London, England

[21] Appl. No.: 868,723

[22] Filed: May 30, 1986

[30] Foreign Application Priority Data

Jun. 4, 1985 [GB] United Kingdom ..... 8514005

[51] Int. Cl.[4] ..... E21B 43/24; E21C 37/12

[52] U.S. Cl. ..... 299/17; 166/303; 175/67

[58] Field of Search ..... 166/303, 306; 175/67, 175/55, 56; 299/16, 17

[56] References Cited

U.S. PATENT DOCUMENTS

| | | | |
|---|---|---|---|
| 823,749 | 6/1906 | Wanner | 299/17 |
| 2,745,647 | 5/1956 | Gilmore | 299/17 X |
| 3,375,884 | 4/1968 | Bodine, Jr. . | |
| 3,393,013 | 7/1968 | Hammer et al. | 299/17 |
| 3,556,597 | 1/1971 | Porter | 175/67 X |
| 3,808,820 | 5/1974 | Bodine | 175/55 X |
| 3,839,875 | 10/1974 | Matsushita | 175/67 X |
| 3,951,457 | 4/1976 | Redford | 166/303 X |
| 4,348,058 | 9/1982 | Coakley et al. | 299/17 |
| 4,350,203 | 9/1982 | Widmyer | 166/303 X |
| 4,406,499 | 9/1983 | Yildirim | 299/17 |
| 4,527,836 | 7/1985 | Uhri | 299/17 |
| 4,548,281 | 10/1985 | Bodine | 299/17 X |

FOREIGN PATENT DOCUMENTS

| | | | |
|---|---|---|---|
| 745115 | 7/1980 | U.S.S.R. | 299/17 |
| 1093813 | 5/1984 | U.S.S.R. | 299/17 |

*Primary Examiner*—George A. Suchfield
*Attorney, Agent, or Firm*—Morgan & Finnegan

[57] ABSTRACT

A method for the extraction of a mineral from an underground unconsolidated formation comprises the steps of:

(a) driving a casing through the overburden and into the mineral bearing pay zone, (b) passing a high pressure water jet head and associated supply line down through the casing so that an annulus is formed between the casing and the supply line and the jet head projects just beyond the casing, (c) directing water from the jet head into the pay zone to cause disintegration of the latter, (d) recovering desired product through the annulus between the piping and the casing, (e) moving the jet head to a different level in the pay zone when the previous level is effectively exhausted, and (f) moving the casing in association with the jet head so that the latter remains in the same operating position with respect to the casing with the jet head projecting just beyond the casing.

The method is particularly suitable for extracting bitumen from tar sands.

5 Claims, 1 Drawing Figure

BOREHOLE EXTRACTION OF MINERALS

This invention relates to a method for the extraction of minerals from underground unconsolidated formations and in particular to a method for the recovery of bitumen from tar sands.

Borehole mining is a known technique for the extraction of minerals which comprises drilling and fixing casing until the pay zone is reached. The ore is then hydraulically mined by directing high velocity water jets onto it to form a slurry and pumping the slurry to the surface.

This technique suffers from the disadvantage that the casing cannot project into the pay zone without blocking off that section into which it projects. This means that the jet heads must at some time project considerably beyond the casing without support. During operations, the jet reaction forces will inevitably be out of balance and these will cause the unsupported jet head and its supply line to flex and vibrate from the point at the top of the pay zone where a fixed casing would have to terminate. In deep pay zones breakage due to fatigue is likely and the jet head and supply line are liable to be trapped by subsidence.

We have now discovered that this problem may be overcome if a movable casing is brought close to the jet head and moved in association with it.

Thus according to the present invention there is provided a method for the extraction of a mineral from an underground unconsolidated formation which method comprises the steps of:

(a) driving a casing through the overburden and into the mineral bearing pay zone (b) passing a high pressure water jet head and associated supply line down through the casing so that an annulus is formed between the casing and the supply line and the jet head projects just beyond the casing, (c) directing water from the jet head into the pay zone to cause disintegration of the latter, (d) recovering desired product through the annulus between the piping and the casing, (e) moving the jet head to a different level in the pay zone when the previous level is effectively exhausted, and (f) moving the casing in association with the jet head so that the latter remains in the same operating position with respect to the casing with the jet head projecting just beyond the casing.

Figure 1:
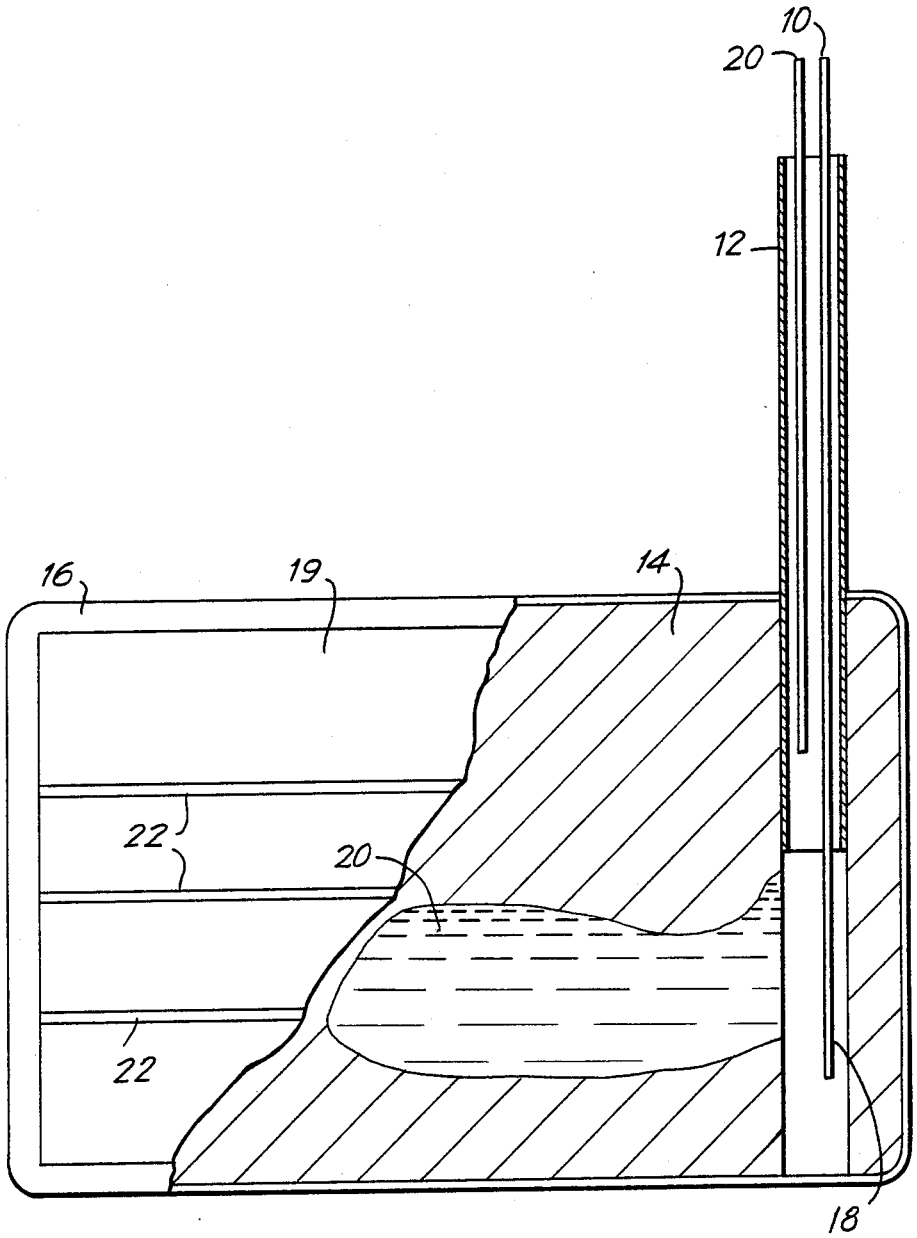
FIG. 1 is a frontal view in partial cross-section of an apparatus in accordance with one embodiment of the present invention.

The jet head and its associated supply line 10 are continuously supported by the casing 12 and are therefore not subjected to flexing and vibration.

The casing is preferably moved by subjecting it to vibration in the sonic frequency range. Sonic frequency range vibration generators are known per se.

In practice, the casing will usually be driven initially to the bottom of the pay zone 14 and raised with the water jet head during operation. However, the opposite situation is also within the scope of the present invention.

The overburden may be soil, sand, gravel, clay or similar unconsolidated material.

When the casing is lowered, its own weight, together with the vibration, will normally be sufficient to cause it to move downwardly.

By the application of sonic vibration and tensile axial forces the casing may be raised either simultaneously with the supply line and jet head or before or after, conveniently in stages for the detachment of sections.

When no vibration is applied, the casing adheres firmly to the surrounding formation.

Normally the casing will not be rotated and the jet head will be caused to move through 180° in either direction at controlled frequencies.

A method according to the present invention may be used for the extraction of alluvial gold and diamonds, and bitumen from tar sands.

In the case of the latter, the product from the borehole may be recovered as a slurry of tar sand in water requiring further separation on the surface, or, more preferably, as a liquid mixture of water and bitumen with the sand being left down the hole.

In this particular treatment, the water is preferably heated and, if desired, an alkali may be added to assist in the in-situ stripping of bitumen from the sand.

It is a particular advantage of this mode of operation that only bitumen and water are raised to the surface. In principle, clean sand is left behind to fill the caverns produced by the water jets.

It will be apparent that this mode of operation is particularly suitable for use in thick pay zones extending over a considerable depth in which the problem associated with an unsupported jet head would become acute.

It may not be so apparent, however, that the method is also particularly suitable for dealing with shallow deposits. It is generally considered that tar sand deposits less than 150 m below the surface are not amenable to conventional in-situ recovery methods because there is insufficient overburden to contain the necessary pressures. Deposits with less than 50 m overburden are generally considered to be suitable for surface mining. Hydraulic mining is particularly applicable in the overburden range of 50 to 150 m.

The invention is illustrated by the following example.

EXAMPLE 1

A tar sand bed was formed within a glass-fronted box 16, the tar sand being material mined in the region of Fort McMurray, Alberta and compacted by systematic tamping to achieve a packed density of 1.8–2.0. A vertical borehole partly cased with a retractable tube was created at one side of the box and a model mining tool essentially comprising a single destructor jet 18 of 1 mm diameter was inserted such as to project a horizontal stream of leachant (hot water at 80° C.) against the tar sand along the length of the box within 19 about 25 mm of the face of the window. For the purpose of demonstration the destructor jet 18 was not moved in the horizontal plane but was lifted periodically in order to extend the cavity. A lift pump 20 extracted the leachant to an external weir and skimmer system which removed the bulk of the bitumen before returning the leachant to the pump feeding the destructor jet.

A jet velocity of 20 $ms^{-1}$ was used and time lapse photography used to record the growth of the cavern dimensions as seen in the vertical plane. It was found necessary to provide 3 horizontal "anti-slump" bars 22 on the window face and opposing face of the box to inhibit slipping of the tar sand down the vertical faces before the full cavity had been formed.

With the above system it was found that the cavity formed progressively over a period of 40 minutes with its length in the direction of the jet increasing to 155 mm, the cavern height being approx. 50 mm. Cleaned sand 24 accumulated in the floor of the cavern. At this stage the model mining tool was raised by approximately 50 mm and a further 40 minutes of jet leaching ensued. The additional increase in cavern dimensions were further recorded during this period and established additional cavern height of 75 mm with length maintained at 160 mm. A second lift of 50 mm created further cavern height of 70 mm and length maintained at 160 mm.

The experiment proved that cavern generation and extension was possible and controllable providing that operators had knowledge of the cavern dimension and/or bitumen production rate and actuated the mining tool accordingly, a procedure which in full scale operation would be facilitated by controlled retraction of the support casing as previously described.

I claim:

1. A method for the extraction of a mineral from an underground unconsolidated formation which method comprises the steps of:

(a) driving a casing through the overburden and initially to the bottom of the mineral bearing pay zone using a sonic vibration generator, (b) passing a high pressure water jet head and associated supply line down through the casing so that an annulus is formed between the casing and the supply line and the jet head projects just beyond the casing, (c) directing water from the jet head into the pay zone to cause disintegration of the latter, (d) recovering desired product through the annulus between the piping and the casing, (e) raising the casing with the water jet head to a different level in the pay zone when the previous level is effectively exhausted such that the jet head remains in the same operating position with respect to the casing with the jet head projecting just beyond the casing.

2. A method according to claim 1 wherein the mineral bearing pay zone is tar sand.

3. A method according to claim 2 wherein the water is heated.

4. A method according to claim 2 wherein an alkali is added to the water.

5. A method according to claim 2 wherein the product is recovered as a liquid mixture of water and bitumen.

* * * * *